US007192534B2

(12) United States Patent
Lunkwitz et al.

(10) Patent No.: US 7,192,534 B2
(45) Date of Patent: Mar. 20, 2007

(54) LOW-VOC STUFFING AGENTS, THE USE THEREOF IN THE PRODUCTION AND/OR TREATMENT OF LEATHER AND SKINS AND CORRESPONDING PRODUCTION OR TREATMENT METHOD

(75) Inventors: Ralph Lunkwitz, Neustadt (DE); Andreas Seitz, Birkenheide (DE); Gunther Pabst, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 263 days.

(21) Appl. No.: 10/503,306

(22) PCT Filed: Feb. 20, 2003

(86) PCT No.: PCT/EP03/01740

§ 371 (c)(1),
(2), (4) Date: Aug. 3, 2004

(87) PCT Pub. No.: WO03/070988

PCT Pub. Date: Aug. 28, 2003

(65) Prior Publication Data

US 2005/0224745 A1 Oct. 13, 2005

(30) Foreign Application Priority Data

Feb. 21, 2002 (DE) ..... 102 07 277

(51) Int. Cl.
*C14C 9/02* (2006.01)

(52) U.S. Cl. ..... 252/8.57; 8/94.1 R; 8/94.18; 8/94.19 R; 8/94.22; 427/389

(58) Field of Classification Search ..... 252/8.57; 8/94.1 R, 94.18, 94.19 R, 94.22; 427/389
See application file for complete search history.

(56) References Cited

U.S. PATENT DOCUMENTS 5,075,390 A * 12/1991 Fong ..... 525/379
5,348,807 A 9/1994 Hodder et al.
5,634,949 A * 6/1997 Hohmann et al. ..... 8/527
5,668,206 A 9/1997 Dubs et al.
5,705,083 A 1/1998 Wyss et al.
6,048,467 A 4/2000 Dahmen et al.
2004/0216241 A1* 11/2004 Pabst et al. ..... 8/94.15

FOREIGN PATENT DOCUMENTS

| | | | |
|---|---|---|---|
| DE | 28 43 755 | A1 | 4/1979 |
| DE | 101 43 949 | A1 | 3/2003 |
| EP | 0466 392 | A2 | 1/1992 |
| EP | 0 498 634 | A2 | 8/1992 |
| EP | 0 665 294 | A2 | 8/1995 |
| EP | 0 753 585 | A2 | 1/1997 |
| GB | 2005 717 | A | 4/1979 |
| WO | WO 98/10103 | | 3/1998 |

* cited by examiner

*Primary Examiner*—Anthony J. Green
(74) *Attorney, Agent, or Firm*—Novak Druce & Quigg LLP

(57) ABSTRACT

Agents for the fatliquoring of, in particular, leathers and hides tanned in the absence of chromium comprise
A) at least one modified natural oil and
B) at least one stabilizer $L_nR$ in which L—is

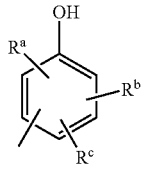

where $R^a$ is H or methyl, $R^b$ is methyl, ethyl or tert-butyl, $R^c$ is methyl, tert-butyl, cyclohexyl or methylcyclohexyl, R is an n-valent $C_3$- to $C_{30}$-hydrocarbon radical which is unsubstituted or substituted and/or contains hetero atoms and n is an integer from 1 to 10,
the stabilizer $L_nR$ having altogether at least 20, in particular altogether at least 28, carbon atoms, and, where n is 2, —R— also being —S—, —O—, —N(H)—, —$CH_2$—, —$(CH_2)_2$—, —$CH(CH_3)$—, —$CH_2)_3$—, —$CH(C_2H_5)$— or —$C(CH_3)_2$—.

The novel fatliquoring agents are used in leather production and/or leather treatment, and leather is produced and/or treated using aqueous dispersions of these fatliquoring agents.

20 Claims, No Drawings

LOW-VOC STUFFING AGENTS, THE USE THEREOF IN THE PRODUCTION AND/OR TREATMENT OF LEATHER AND SKINS AND CORRESPONDING PRODUCTION OR TREATMENT METHOD

The present invention relates to low-VOC fatliquoring agents, their use in the production and/or treatment of leather and hides and processes for the production and/or treatment of leather and hides using the fatliquoring agents according to the invention.

Fatliquoring agents are used in leather production for softening the leather, for increasing its body and strength and for protection from moisture, dirt and external chemical influences (cf. H. Herfeld, "Bibliothek des Leders" 1985, Volume 4, page 13 et seq.). Commercial fatliquoring agents consist, as a rule, of fat-providing substances, such as natural fats, natural oils, waxes, resins and derivatives thereof and/or mineral oil fractions and secondary products thereof, and waxy products, such as wool fat, in crude, purified and/or prepared (lanolin) form (cf. H. Herfeld, "Bibliothek des Leders" 1985, Volume 4, page 59 et seq.). The fat-providing substances can, if desired, be chemically modified, i.e. can be present in a modified chemical structure.

The chemical modification of the fat-providing substances consists, as a rule, in subjecting at least some of the double bonds contained in these substances to addition reactions or oxidation reactions. Frequently performed modifications consist, for example, in the addition of sulfites, with the result that sulfo groups are introduced into the fat-providing substances, or in atmospheric oxidation, with the result that oxygen functions are introduced and in some cases oligomerizations also occur. However, (partial) hydrolysis of the fats, transesterifications and similar modification reactions are also possible.

These chemical modifications make it possible for the performance characteristics of the fat-providing substances, such as hydrophilic character, hydrophobic character, solubility, dispersing power and penetration and anchoring properties to be optimally adapted to specific intended uses or to the users' requirements. In particular, high-quality automotive upholstery leathers must fulfill certain criteria. What is important on the one hand is the softness of the leather and on the other hand the fastness to light and heat and finally the fogging behavior.

DIN 75201 defines fogging as condensation of vaporized components from the interior trim of the vehicle, such as the automotive upholstery leathers, on the glass panes, in particular on the windscreen. This can lead to poorer visibility through the windscreen, in particular when driving at night, and hence to a safety risk. According to DIN 75201, the fogging behavior of leather is characterized by a gravimetric and a reflectometric method.

In order to prevent fogging, it is therefore an object to reduce the amount of organic compound which can emerge again from the treated leather after processing ("volatile organic compounds"). However, the use of organic compounds, such as solvents, is sometimes difficult to avoid. This is because the fatliquoring agent is often diluted with solvent for application, in order to ensure a good distribution of the fatliquoring agent on the leather. Some possibilities of avoiding this problem are known from the prior art.

Thus, EP-A 0 498 634 recommends special polymers for the production of leathers having low fogging properties. Here, the aqueous dispersions used in the leather treatment are substantially free of organic solvents and contain an amphiphilic copolymer. This copolymer consists of a predominant proportion of at least one hydrophobic monomer and a small proportion of at least one hydrophilic monomer. The leather treatment with these dispersions leads to good results in a gravimetric test according to DIN 75201. The reflectometric investigations were not described.

The preparation of these amphiphilic copolymers is preferably carried out by emulsion polymerization in aqueous solution. Owing to the different hydrophilic characters of the monomers to be used, however, there are of course problems in the copolymerization behavior. In the extreme case, this can result in the monomers each forming homopolymers in an undesired manner. A further consequence of the essentially disadvantageous dissolution conditions is an expensive working-up to destroy unconverted monomers. In order to achieve good emulsion stability, it is moreover necessary to add a sufficient amount of an emulsifier (lauryl sulfate is used in the examples mentioned), which can lead to wastewater problems in leather processing.

EP-B 0 466 392 describes a process for the preparation of polymers which contain both hydrophobic side groups and hydrophilic alkoxylated side groups. Such polymers are obtained by carrying out derivatization reactions known to a person skilled in the art after the actual polymerization process. Thus, polymers are preferably prepared from simple monomers, such as acrylamide and/or acrylic acid, by conventional polymerization and then derivatized with a mixture of primary and/or hydrophobic amines and/or primary or secondary alkoxylated amines. The polymers described are used as thickeners and dirt removers. Their use in the treatment of leather is not described.

In the process according to WO 98/10103, polymeric fatliquoring agents are prepared by polymerization of acrylic acid and/or methacrylic acid and/or their acid chlorides and/or their anhydrides with further copolymerizable water-soluble monomers and with copolymerizable water-insoluble monomers and subsequent reaction of the polymers thus obtained with amines. According to DIN 75201 B (gravimetric test), fogging values of 1.2 mg and 1.5 mg are found for leathers which have been treated with these polymeric fatliquoring agents. The leathers treated with the comparative products Magnopal® SOF (low-fogging polymer fatliquoring agent from Stockhausen GmbH & Co. KG) and Chromopol® LFC (low-fogging fatliquoring agent based on fish oils from Stockhausen GmbH & Co. KG) achieve fogging values of 3.9 mg and 3.5 mg, respectively. The reflectometric values, according to DIN 75201 A, of the polymeric fatliquoring agent are 51% and 55%, respectively, and those of the comparative products are 34% and 40%, respectively.

U.S. Pat. No. 5,348,807, too, describes a process in which selected amphiphilic copolymers consisting of a predominant proportion of hydrophobic groups and a smaller proportion of hydrophilic groups are used as solvent-free low-fogging fatliquoring agents. For the preparation of these polymers, acidically or basically substituted esters of unsaturated carboxylic acids, e.g. sulfatoethyl (meth)acrylate or dimethylaminoethyl (meth)acrylate, are used as hydrophilic monomers. Hydrophobic monomers used are, for example, longer-chain alkenes or (meth)acrylic esters of $C_4$- to $C_{12}$-alkanols or vinyl esters of $C_4$- to $C_{12}$-carboxylic acids. The substances give good fogging values; however, there is no information about the bath exhaustion.

In this process, too, the preparation of the amphiphilic copolymers is preferably carried out by aqueous emulsion polymerization. However, owing to the different hydrophilic characters of the monomers to be used, this once again leads to the problems mentioned above in the discussion of EP-A 0 498 634.

EP-B 0 753 585 describes a low-fogging surface treatment for furniture leather, in which specially treated natural oils which have-less than 3% of fatty acid components of less than 16 carbon atoms act as a basis for fatliquoring agents. Natural oils used are soybean, lard, safflower and sunflower oil. Said natural oils are first distilled in order to remove the undesired low molecular weight components and then reacted with hydrogen sulfite or hydrogen sulfate in order to improve the emulsifiability. The (partly) functionalized oils are then emulsified and used.

In order to avoid the use of organic solvents for distributing the fatliquoring agent, the non-prior-published DE-A 101 43 949.0 of the Applicant describes the use of a special emulsifier composition which comprises three components A, B and C. Here, the component A is a $C_6$- to $C_{14}$-alkanol alkoxylated with from 4 to 12 AO units, or a mixture of a plurality of such alkanols, the component B is a $C_{12}$–$C_{24}$ fatty alcohol mixture alkoxylated with from 15 to 40 AO units and the component C is a $C_{12}$ to $C_{24}$ fatty alcohol mixture alkoxylated with from 50 to 100 AO units. The AO units are expediently alkylene oxide building blocks of 2 to 4, preferably 2 or 3, carbon atoms. The building blocks of the polyether chains may all be identical or different and, if they are different, may be arranged randomly or blockwise. The amounts by weight of the components in the emulsifier composition are from 20 to 60, preferably from 25 to 50, in particular from 28 to 40, % by weight for the component A, from 20 to 70, preferably from 25 to 60, in particular from 30 to 45, % by weight for the component B and from 10 to 50, preferably from 15 to 40, in particular from 22 to 32, % by weight for the component C, the percentages being based on the total weight of the composition.

It is an object of the present invention to provide a fatliquoring agent which substantially avoids the disadvantages of the prior art. The leathers treated with these fatliquoring agents should have a low VOC content and, if required, should have sufficient fastness to light and heat.

We have found that this object is achieved, according to the invention, by a fatliquoring agent comprising A) at least one modified natural oil and B) at least one stabilizer $L_nR$ in which in which L—is

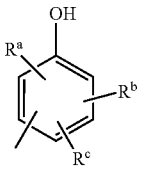

$R^a$ is H or methyl, $R^b$ is methyl, ethyl or tert-butyl, $R^c$ is methyl, tert-butyl, cyclohexyl or methylcyclohexyl, R is an n-valent, saturated or unsaturated, linear aliphatic $C_3$- to $C_{30}$- or branched aliphatic $C_4$- to $C_{30}$- or (hetero) cycloaliphatic $C_4$- to $C_{30}$- or (hetero)aromatic $C_4$- to $C_{30}$-hydrocarbon radical which is unsubstituted or substituted by carbonyl, alkylcarbonyloxy, alkylcarbamoyl and/or alkoxycarbonyl groups and/or contains O, N(H) and/or S units, and n is an integer from 1 to 10, the stabilizer $L_nR$ having altogether at least 20, in particular altogether at least 28, carbon atoms and where n is 2, —R— also being —S—, —O—, —N(H)—, —$CH_2$—, —$(CH_2)_2$—, —$CH(CH_3)$—, —$(CH_2)_3$—, —$CH(C_2H_5)$— or —$C(CH_3)_2$—.

In the context of the present invention, (hetero)cycloaliphatic $C_4$- to $C_{30}$-hydrocarbon radicals are understood as meaning saturated, monounsaturated or polyunsaturated $C_4$- to $C_{30}$-hydrocarbon rings in which methylene groups —$CH_2$— may have been replaced by —O—, —N(H)— and/or —S—, and which may carry one or more linear $C_1$- to $C_{10}$-alkyl radicals, linear $C_1$- to $C_{10}$-alkylene bridges, branched $C_3$- to $C_{10}$-alkyl radicals and/or branched $C_3$- to $C_{10}$-alkylene bridges, which may be monounsaturated or polyunsaturated. In the context of the present invention, (hetero)cycloaliphatic $C_4$- to $C_{30}$-hydrocarbon radicals are also understood as meaning lactones and lactams which are unsubstituted or substituted by one or more saturated, monounsaturated or polyunsaturated, linear $C_1$- to $C_{10}$-alkyl radicals and/or branched $C_3$- to $C_{10}$-alkyl radicals, and urea derivatives. The term covers both monocyclic and polycyclic ring systems, in particular bicyclic and tricyclic ring systems.

In the context of the present invention, (hetero)aromatic $C_4$- to $C_{30}$-hydrocarbon radicals are understood as meaning aromatic $C_4$- to $C_{30}$-ring systems in which one or more —C(H)═ may have been replaced by —N═, and which may carry one or more linear $C_1$- to $C_{10}$-alkyl radicals, linear $C_1$- to $C_{10}$-alkylene bridges, branched $C_3$- to $C_{10}$-alkyl radicals and/or branched $C_3$- to $C_{10}$-alkylene bridges and/or may contain units such as —O—, —S— and/or —N(H)—. The term covers both monocyclic and polycyclic ring systems, in particular bicyclic and tricyclic ring systems. Explicit examples which, however, are not intended to be limiting, are phenyl, tolyl, cumyl, naphthyl, phenanthryl, pyridyl and indyl, which are unsubstituted or substituted by one or more linear $C_1$- to $C_{10}$-alkyl radicals, linear $C_1$- to $C_{10}$-alkylene bridges, branched $C_3$- to $C_{10}$-alkyl radicals and/or branched $C_3$- to $C_{10}$-alkylene bridges.

The fatliquoring agents according to the invention are particularly suitable for the fatliquoring of leathers and hides, since the leathers and hides thus treated exhibit little fogging. In particular, the fatliquoring agents according to the invention are used for leathers and hides tanned in the absence of chromium. Tanning in the absence of chromium is understood as meaning all the tanning processes for leathers and hides in which no Cr(III) is used for the tanning. In particular, it is understood as meaning processes known to a person skilled in the art, such as vegetable tanning, syntan tanning and wet white tanning. Surprisingly, it has been found that chrome-tanned leathers treated with the fatliquoring agents according to the invention (wet blue tanning) have particularly good fastness properties with respect to heat yellowing in comparison with chrome-tanned leathers which were treated with conventional fatliquoring agents.

Better advantages are obtained if natural oils modified by oxidation and/or sulfitation and/or modified phospholipids are used as component A).

Modified natural oils which have a relatively high degree of oxidation and a relatively low degree of sulfitation are particularly advantageous. Of the modified phospholipids, those phospholipids which are partly acetylated, i.e. those phospholipids in which an esterified fatty acid was partly replaced by esterified acetic acid, are preferred. By means of the partial transesterification, the viscosity and the hydrophilic character of the phospholipid can be adjusted. The acetylation is carried out by the processes known to a person skilled in the art. A particularly preferred example of a modified phospholipid is acetylated lecithin.

Expediently used natural oils are fats of vegetable or animal origin, in particular glycerides of natural fatty acids, with a sufficient proportion of unsaturated acids. Suitable natural oils are those having an iodine number of from about 10 to about 200. For example, oleic acid and tung oil are present in the lower section of this range, and in particular the fish oils and chaulmoogra oil in the upper section. Natural oils having iodine numbers of from about 30 to about 120, in particular from 40 to 85, are preferred.

Examples of particularly preferred natural oils are fish oil, neatsfoot oil, lard oil, soybean oil, rapeseed oil, nut oil, olive oil and castor oil.

The sulfitation products or oxidation products of the monounsaturated or polyunsaturated fats form through the reaction of the olefinic double bonds present in the fats with the sulfitation and/or oxidation reagents. All double bonds present in the fats or only some of them may react.

For example, air at from 60 to 80° C. is used as an oxidation reagent. However, the oxidation can also be carried out by other methods known to a person skilled in the art. A relatively high degree of oxidation is present in the meaning of this invention if Δd, the difference between the specific gravities of the oil or fat before and after the oxidation, is from 0.01 to 0.1, preferably from 0.03 to 0.05, g/ml.

The sulfitation is generally carried out by reaction in aqueous bisulfite liquor. However, it can also be carried out by other methods known to a person skilled in the art. A relatively low degree of sulfitation in the meaning of this invention is present when the natural oil has been reacted with from 2 to 8, preferably from 3 to 5, % by weight based on its weight, of a sulfite, calculated as sodium bisulfite ($Na_2S_2O_5$).

Stabilizers $L_nR$ having altogether at least 20, in particular altogether at least 28, carbon atoms are used as component B). Preferably, L—is one of the following radicals:

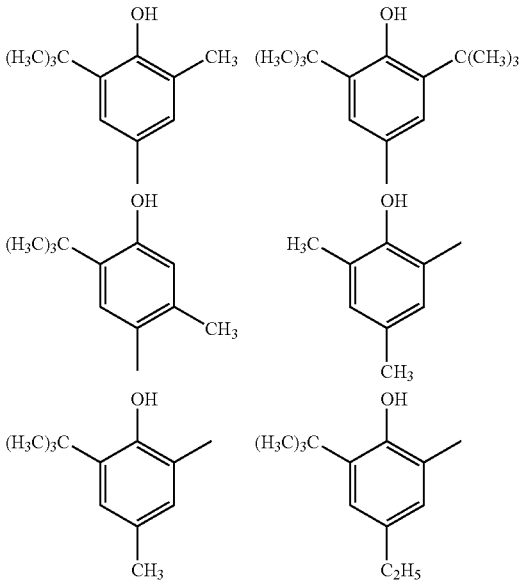

-continued

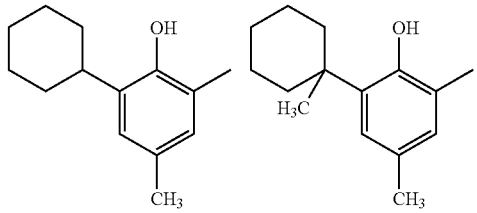

and/or n is an integer from 1 to 4.

Preferred monovalent radicals R are linear or branched saturated alkyl radicals and linear or branched alkyl radicals —$(C_mH_{2m})$—C(O)$OX^1$ substituted by alkoxycarbonyl groups, where m is an integer from 0 to 28 and $X^1$ is a linear alkyl radical of 1 to 28 carbon atoms or a branched alkyl radical of 3 to 28 carbon atoms.

Other preferred monovalent radicals R are phenol derivatives which are bonded to L via linear $C_1$- to $C_4$-alkylene bridges or branched $C_3$- or $C_4$-alkylene bridges, may be etherified with (un)saturated linear $C_1$- to $C_{10}$-alkanols or (un)saturated branched $C_4$- to $C_{10}$-alkanols or esterified with (un)saturated linear $C_1$- to $C_{10}$-carboxylic acids or (un) saturated branched $C_4$- to $C_{10}$-carboxylic acids and may be substituted on the phenyl ring by one or more linear $C_1$- to $C_{10}$- and/or branched $C_3$- to $C_{10}$-alkyl radicals and/or $C_6$- to $C_{12}$-cyclcoalkyl radicals.

The etherified or esterified phenol derivatives are preferably the radicals L—which are mentioned above as being preferred and are substituted by linear $C_1$- to $C_4$-alkylene bridges or branched $C_3$- or $C_4$-alkylene bridges, the hydroxyl group being etherified with (un)saturated linear $C_1$- to $C_{10}$-alkanols or (un)saturated branched $C_4$- to $C_{10}$-alkanols or esterified with (un)saturated linear $C_1$- to $C_{10}$-carboxylic acids or (un)saturated branched $C_4$- to $C_{10}$-carboxylic acids.

Very particularly preferred monovalent radicals R are: —$(CH_2)_9H$, —$CH(CH_3)$—$(CH_2)_{14}H$, —$(CH_2)_2$—C(O)$OCH_3$, —$(CH_2)_2$—C(O)O$iC_8H_{17}$, —$(CH_2)_2$—C(O)O$(CH_2)_{18}H$, and

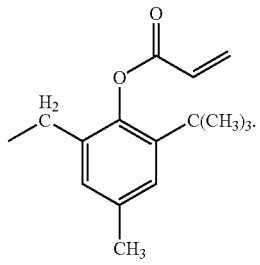

The last radical R is commercially available as L—R with L=3-tert-butyl-2-hydroxy-5-methylphenyl under the trade name Irganox® 3052 from CIBA Spezialitätenchemie AG in Basle. The compound L—R with L=3,5-di-tert-butyl-4-hydroxyphenyl and R=—$(CH_2)_2$—C(O)O$iC_8H_{17}$ is commercially available, for example, under the trade name Irganox® 1135 from CIBA Spezialitätenchemie AG in Basle. The compound L—R with L=3,5-di-tert-butyl-4-hydroxyphenyl and R=—$(CH_2)_2$—C(O)O$C_{18}H_{37}$ is available under the name Irganox® 1076 from CIBA Spezialitätenchemie AG in Basle, under the name Dovernox® 76 from Chance & Hunt and under the name Ralox® 530 from Raschig GmbH in Ludwigshafen and, together with L—R (with L=2-hydroxy-3,5-dimethylphenyl and R=—$CH(CH_3)C_{14}H_{29}$), under the name Irganox 1141® from CIBA Spezialitätenchemie AG in Basle.

Preferred divalent radicals R are saturated, monounsaturated or polyunsaturated, linear $C_1$- to $C_{18}$-alkylene groups and branched $C_3$- to $C_{18}$-alkylene groups which may contain ester groups —C(O)O— and/or amido groups —C(O)N(H)— and/or hydrazide groups —C(O)—N(H)—N(H)—C(O)— in the hydrocarbon chain of the alkylene groups and/or in which one or more methylene groups —$CH_2$— may have been replaced by —S—, —O— or —N(H)— in the hydrocarbon chain of the alkylene groups. Further preferred divalent radicals R are —S—, —O— and —N(H)—.

Particularly preferred divalent radicals R are:

—S—, —O—, —N(H)—, —$CH_2$—, —$CH(CH(CH_3)_2)$—, —$CH(CH_2—CH_2—CH_3)$—,

—$(CH_2)_2$—C(O)—N(H)—N(H)—C(O)—$(CH_2)_2$—,

—$(CH_2)_2$—C(O)—O—$(CH_2)_6$—O—C(O)—$(CH_2)_2$—,

—$(CH_2)_2$—C(O)—N(H)—$(CH_2)_6$—N(H)—C(O)—$(CH_2)_2$—,

—$(CH_2)_2$—C(O)—$(O—CH_2—CH_2)_3$—O—C(O)—$(CH_2)_2$— and

—$(CH_2)_2$—C(O)—O—$CH_2$—$CH_2$—S—$CH_2$—$CH_2$—O—C(O)—$(CH_2)_2$—.

$L_2R$ with L=3-tert-butyl-2-hydroxy-5-methylphenyl and R=—$CH_2$— is available under the name Ralox® 46 from Raschig GmbH Ludwigshafen. $L_2R$ with L=3,5-di-tert-butyl-4-hydroxyphenyl and R=—$CH_2$— is available under the name Ralox® 02 S from Raschig GmbH Ludwigshafen. $L_2R$ with L=3-tert-butyl-4-hydroxy-3-methylphenyl and R=—$(CH_2)_2$—C(O)—$(O—CH_2—CH_2)_3$—O—C(O)—$(CH_2)_2$— is available, for example, under the trade name Irganox® 245, $L_2R$ with L=3,5-di-tert-butyl-4-hydroxyphenyl and R=—$(CH_2)_2$—C(O)—O—$(CH_2)_6$—O—C(O)—$(CH_2)_2$— under the trade name Irganox® 259, $L_2R$ with L=3,5-di-tert-butyl-4-hydroxyphenyl and R=—$(CH_2)_2$—C(O)—O—$CH_2$—$CH_2$—S—$CH_2$—$CH_2$—O—C(O)—$(CH_2)_2$— under the trade name Irganox® 1035, $L_2R$ with L=3,5-di-tert-butyl-4-hydroxyphenyl and R=—$(CH_2)_2$—C(O)—N(H)—$(CH_2)_6$—N(H)—C(O)—$(CH_2)_2$— under the trade name Irganox® 1098 and under the trade name Ralox® 198 from Raschig GmbH in Ludwigshafen and $L_2R$ with L=3,5-di-tert-butyl-4-hydroxyphenyl and R=—$(CH_2)_2$—C(O)—N(H)—N(H)—C(O)—$(CH_2)_2$— under the name Irganox® MD 1024—all from CIBA Spezialitätenchemie AG in Basle. $L_2R$ with L=5-tert-butyl-4-hydroxy-2-methylphenyl and R=—S— is available under the trade name Santanox® R and $L_2R$ with L=5-tert-butyl-4-hydroxy-2-methylphenyl and R=—$CH(CH_2CH_2—CH_3)$— is available under the name Santowhite® powder, both from Monsanto Company in St. Louis, USA.

Preferred trivalent radicals R are trivalent linear $C_3$- to $C_{10}$- or branched, (a)cyclic, (un)saturated $C_4$- to $C_{10}$- or aromatic $C_6$–$C_{10}$-hydrocarbon radicals in which three protons in each case have been replaced by the radical L. In these preferred hydrocarbon radicals, methylene groups —$CH_2$— present may have been replaced by —N(H)—.

Here, the hydrogen atoms on the nitrogen in the —N(H)— groups may have been replaced by linear $C_1$- to $C_{10}$-alkyl radicals and/or by branched $C_3$- to $C_{10}$-alkyl radicals and/or by $C_6$- to $C_{12}$-cycloalkyl radicals. The bonding of the radical L can also be effected via linear $C_1$- to $C_{10}$-alkylene bridges or branched $C_3$- to $C_{10}$-alkylene bridges to such a nitrogen atom. In these alkylene bridges, too, methylene groups —$CH_2$— may have been replaced by —O—, —N(H)— or —S—.

Particularly preferred trivalent radicals R are selected from the following group:

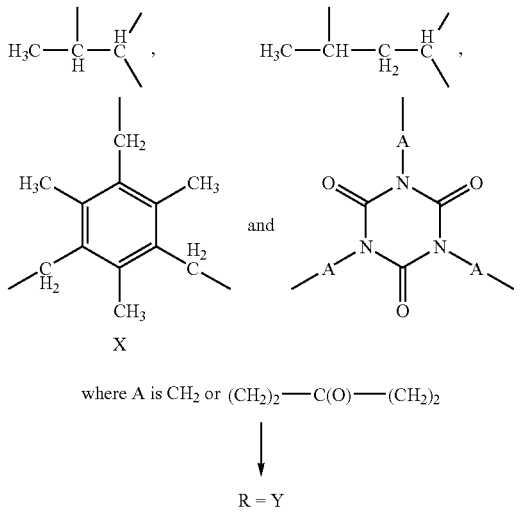

$L_3R$ with L=5-tert-butyl-4-hydroxy-2-methylphenyl and R=1,1,3-butanetriyl is available, for example, under the trade name Topanol CA from Chance & Hunt, $L_3R$ with L=3,5-di-tert-butyl-4-hydroxyphenyl and R=X under the trade name Irganox® 1330 from CIBA Spezialitätenchemie AG in Basle and Ethanox® 330 from Albemarle Corporation, $L_3R$ with L=3,5-di-tert-butyl-4-hydroxyphenyl and R=Y under the name Irganox® 3114 from CIBA Spezialitätenchemie AG in Basle and under the name Ralox® 3114 from Raschig GmbH in Ludwigshafen and $L_3R$ with L=4-tert-butyl-3-hydroxy-2,6-dimethylphenyl and R=Y under the trade name Cyanox® 1790 from Cytec.

Preferred R are tetravalent, saturated linear $C_3$- to $C_{20}$- or branched aliphatic $C_4$- to $C_{20}$-hydrocarbon radicals which are substituted by alkylcarbonyloxy groups and/or obtain O— and/or N(H) units and in which four protons have been replaced by the radicals L.

An example of particularly preferred R is $C(CH_2—(O)—C(O)—CH_2—CH_2—)_4$. The latter radical R is commercially available as L—R with L=3,5-di-tert-butyl-4-hydroxyphenyl, for example under the trade name Irganox® 1010 from CIBA Spezialitätenchemie AG in Basle, under the name Ralox® 630 from Raschig GmbH in Ludwigshafen and under the name Ethanox® 310 from Albemarle Corporation.

Preferably, the fatliquoring agents according to the invention contain at least 40, particularly preferably at least 50, very particularly preferably at least 70, % by weight of a component A or of a mixture of the components A and not more than 1, particularly preferably not more than 0.5, very particularly preferably not more than 0.2, % by weight of a component B or of a mixture of the components B, based on the total weight of the fatliquoring agent.

The fatliquoring agents according to the invention can be prepared in undiluted form or, depending on the users' wishes, in the form of aqueous dispersions (aqueous liquors), expediently having solids contents of from 40 to 80, preferably from 50 to 80, particularly preferably from 60 to 75, % by weight.

The components of the preferred fatliquoring agents according to the invention, that is the modified natural oils according to the invention and the stabilizers according to the invention, can be added to the fatliquoring liquors together or separately in any desired sequence. The present invention therefore also relates to a process for the fatliquoring of leather and hides by treatment with the above-mentioned aqueous liquors.

The present invention furthermore relates to the use of the fatliquoring agents according to the invention described in leather production. They are used for softening the leather, for increasing its body and strength and for protection from moisture, dirt and external chemical influences.

The presence of the stabilizers according to the invention leads to low fogging values.

The examples which follow illustrate the invention.

EXAMPLES

The composition of the conventional fatliquoring agents A1 to A5 and B1 to B5 used and of the novel fatliquoring agents C1 to C5 and D1 to D5 used is shown in tables 1 and 3. The amount of individual components is stated in % by weight, based on the total fatliquoring agent, and is shown in tables 2 and 4. The nonionic surfactant Lutensol® AT 25 from BASF AG in Ludwigshafen is a $C_{16}$ to $C_{18}$ fatty alcohol mixture which was ethoxylated with 25 mol of ethylene oxide. Irganox® 1076 from CIBA Spezialitätenchemie AG in Basle is $L_nR$ with n=1, L=4-hydroxy-3,5-di-tert-butyl-1-phenyl and R=—$(CH_2)_2$—C(O)O$(CH_2)_{18}$H. Acetylated lecithin is available from Compte & Rivera S. A. in Spain. Triolein is a natural oleic acid triglyceride from Smit & Zoon. Ebotec MO (4-octylisothiazolinone) is a biocide from Bode Chemie in Hamburg.

TABLE 1

Composition of the fatliquoring agents A1 to A5 and C1 to C5

| | Fatliquoring agents A1 to A5 (conventional) | Fatliquoring agents C1 to C5 (according to the invention) |
|---|---|---|
| Component 1 | 90% by weight aqueous solution of a 40:60 mixture of fish oil and rapeseed oil (oil mixture oxidized with air to Δd = 0.01 to 0.1 g/ml and reacted with 4% by weight of $Na_2S_2O_5$, based on oil mixture) | 90% by weight aqueous solution of a 40:60 mixture of fish oil and rapeseed oil (oil mixture oxidized with air to Δd = 0.01 to 0.1 g/ml and reacted with 4% by weight of $Na_2S_2O_5$ based on oil mixture) |
| Component 2 | 50% by weight aqueous NaOH solution | 50% by weight aqueous NaOH solution |
| Component 3 | Reaction product of maleic anhydride with alcohols, subsequently sulfitated and reacted with $NH_3$ or amine | Reaction product of maleic anhydride with alcohols, subsequently sulfitated and reacted with $NH_3$ or amine |
| Component 4 | Lutensol ® AT 25 | Lutensol ® AT 25 |
| Component 5 | 3,5-di-tert-butyl-4-hydroxytoluene | Irganox ® 1076 |

TABLE 2

Ratios of the individual components in the fatliquoring agents A1 to A5 and C1 to C5

| | Fatliquoring agents | | | | | | | | | |
|---|---|---|---|---|---|---|---|---|---|---|
| | A1 | A2 | A3 | A4 | A5 | C1 | C2 | C3 | C4 | C5 |
| Component 1 | 68.5 | 74.5 | 80.5 | 86.5 | 92.5 | 68.5 | 74.5 | 80.5 | 86.5 | 92.5 |
| Component 2 | 2.0 | 2.0 | 2.0 | 2.0 | 2.0 | 2.0 | 2.0 | 2.0 | 2.0 | 2.0 |
| Component 3 | 24.0 | 18.0 | 12.0 | 6.0 | — | 24.0 | 18.0 | 12.0 | 6.0 | — |
| Component 4 | 5.0 | 5.0 | 5.0 | 5.0 | 5.0 | 5.0 | 5.0 | 5.0 | 5.0 | 5.0 |
| Component 5 | 0.5 | 0.5 | 0.5 | 0.5 | 0.5 | 0.5 | 0.5 | 0.5 | 0.5 | 0.5 |

TABLE 3

Composition of the fatliquoring agents B1 to B5 and D1 to D5

| | Fatliquoring agents B1 to B5 (conventional) | Fatliquoring agents D1 to D5 (according to the invention) |
|---|---|---|
| Component 1 | acetylated lecithin | acetylated lecithin |
| Component 2 | 50% by weight aqueous NaOH solution | 50% by weight aqueous NaOH solution |
| Component 4 | Triolein | Rapeseed oil (oxidized with air to Δd = 0.01 to 0.1 g/ml and reacted with 4% by weight of $Na_2S_2O_5$, based on oil) |
| Component 4 | Hexylene glycol | Hexylene glycol |
| Component 5 | Water | Water |
| Component 6 | Ebotec MO | Ebotec MO |
| Component 7 | 3,5-di-tert-butyl-4-hydroxytoluene | Irganox ® 1076 |

TABLE 4

| | Ratios of the individual components in the fatliquoring agents B1 to B5 and D1 to D5 | | | | | | | | | |
|---|---|---|---|---|---|---|---|---|---|---|
| | Fatliquoring agents | | | | | | | | | |
| | B1 | B2 | B3 | B4 | B5 | D1 | D2 | D3 | D4 | D5 |
| Component 1 | 63.0 | 68.0 | 73.0 | 78.0 | 83.0 | 63.0 | 68.0 | 73.0 | 78.0 | 83.0 |
| Component 2 | 1.5 | 1.5 | 1.5 | 1.5 | 1.5 | 1.5 | 1.5 | 1.5 | 1.5 | 1.5 |
| Component 3 | 26.0 | 21.0 | 16.0 | 11.0 | 6.0 | 26.0 | 21.0 | 16.0 | 11.0 | 6.0 |
| Component 4 | 4.8 | 4.8 | 4.8 | 4.8 | 4.8 | 4.8 | 4.8 | 4.8 | 4.8 | 4.8 |
| Component 5 | 4.1 | 4.1 | 4.1 | 4.1 | 4.1 | 4.1 | 4.1 | 4.1 | 4.1 | 4.1 |
| Component 6 | 0.15 | 0.15 | 0.15 | 0.15 | 0.15 | 0.15 | 0.15 | 0.15 | 0.15 | 0.15 |
| Component 7 | 0.7 | 0.7 | 0.7 | 0.7 | 0.7 | 0.7 | 0.7 | 0.7 | 0.7 | 0.7 |

Example 1

Treatment of Chrome-Tanned Leather with Conventional Fatliquoring Agents (A1 to A5, B1 to B5) and Fatliquoring Agents According to the Invention (C1 to C5, D1 to D5)

100 parts by weight of chrome cattle leather having a shaved thickness of from 2.0 to 2.2 mm are placed in 100 parts by weight of water at 40° C. and brought to a pH of 4.5 by adding sodium formate and sodium bicarbonate. The leather is drummed at 40° C. for 60 minutes and then washed with 200 parts by weight of water.

100 parts by weight of water at 40° C. and 2 parts by weight of commercial polymer tanning agent, 4 parts by weight of commercial resin tanning agent and 4 parts by weight of commercial mimosa are then added. Drumming is effected for 90 minutes, after which the leather is dyed in the same liquor with 1 part by weight of a commercial leather dye. Thereafter, the liquor is discharged and 100 parts by weight of water and either 4 parts by weight of a commercial fatliquoring agent (A1 to A5, B1 to B5) or 4 parts by weight of a novel fatliquoring agent (C1 to C5, D1 to D5) of the composition shown in tables 1 to 4 are added to the leather, and the leather is drummed as usual for 60 minutes at 50° C. in this liquor.

The liquor is then brought to a pH of from 3.5 to 3.8 with formic acid and the leather is cold-washed briefly and further treated in a generally customary manner.

A leather having a very good dyeing and tight grain in combination with good body and average softness is obtained. The leather surface has a fatty feel.

Example 2

Treatment of Leather, Tanned in the Absence of Chromium, with Conventional Fatliquoring Agents (A1 to A5, B1 to B5) and Fatliquoring Agents According to the Invention (C1 to C5, D1 to D5)

100 parts by weight of wet white cattle leather having a shaved thickness of 2.0 to 2.2 mm are placed in 100 parts by weight of water and brought to a pH of <3.0 by adding sodium formate and sodium bicarbonate. The leather is drummed at 30° C. for 60 minutes and then washed with 200 parts by weight of water.

Drumming is then effected with 4 parts by weight of a tanning agent, such as Relugan® GTP from BASF AG in Ludwigshafen, for 60 minutes. After the addition of 2 parts by weight of an auxiliary tanning agent, such as Tamol® NA from BASF AG in Ludwigshafen, and drumming for 30 minutes, 4 parts by weight of a conventional fatliquoring agent (A1 to A5, B1 to B5) or 4 parts by weight of a novel fatliquoring agent (C1 to C5, D1 to D5) are added and drumming is effected for a further 60 minutes. After the liquor has been discharged, 100 parts by weight of water at 40° C. and 2 parts by weight of commercial polymer tanning agent, such as Relugan® SE (polymethacrylic acid) from BASF AG in Ludwigshafen, are added. After neutralization with sodium bicarbonate to pH 5 and dyeing of the leather in the same liquor with 0.5 part by weight of a commercial leather dye, for example Luganil® Light Brown NGB from BASF AG in Ludwigshafen, tanning is completed with 30 parts by weight of a commercial sulfone tanning agent, for example Basyntan® SW liquid from BASF AG in Ludwigshafen, and 4 parts by weight of a commercial vegetable tanning agent, such as Granofin TA from Clariant GmbH (Germany), for 2 hours.

Fatliquoring is then carried out with a mixture of 10 to 15 parts by weight of a commercial fatliquoring agent (A1 to A5, B1 to B5) or from 10 to 15 parts by weight of a novel fatliquoring agent (C1 to C5, D1 to D5). Thereafter, the liquor is brought to a pH of from 3.5 to 3.8 with formic acid and the leather is cold-washed briefly and further treated in a generally customary manner.

A leather having very good dyeing and tight grain in combination with very good body and excellent softness with elegant feel is obtained.

Determination of the Fastnesses to Heat Yellowing of the Chrome-Tanned (Wet Blue-Tanned) Leathers Treated with Conventional Fatliquoring Agents (A4, B3) and Fatliquoring Agents According to the Invention (C4, D3)

The fastnesses of the wet blue-tanned leathers obtained after completion of the fatliquoring with the fatliquoring agents A4, B3, C4 or D3 according to example 1 to heat yellowing are determined as a function of the temperature, according to DIN EN 20 105-A02. Here, the leathers are investigated 144 hours after storage at 100° C. or alternatively 4 hours after storage at 120° C. The results of the measurements are shown in table 5.

TABLE 5

| | Fastnesses to heat yellowing, determined according to DIN EN 20 105-A02 | | | |
|---|---|---|---|---|
| Fatliquoring agent | DE - 100° C. | Db - 100° C. | DE - 120° C. | Db - 120° C. |
| A4 (conventional) | 6.76 | 5.39 | 9.20 | 7.88 |
| C4 (according to the invention) | 5.89 | 3.75 | 7.10 | 3.35 |
| B3 (conventional) | 8.01 | 7.31 | 10.38 | 9.76 |
| D3 (according to the invention) | 6.97 | 6.40 | 9.09 | 8.16 |

Db are the values for the heat yellowing and DE is a measure of the gray values. The lower the numerical value, the better the lightfastness.

It was found that the leathers treated with the fatliquoring agents according to the invention (C4, D3) have better fastnesses to heat yellowing in comparison with the leathers treated with conventional fatliquoring agents (A4, B3).

Determination of the VOC or Fogging Values of the Leathers Treated with Conventional Fatliquoring Agents (A4, B3) and Fatliquoring Agents According to the Invention (C4, D3)

The VOC or fogging values of the leathers obtained after completion of the fatliquoring with fatliquoring agents A4, B3, C4 or D3 according to example 2 (wet white tanning) are determined according to DIN 75201 (table 6) and PB VWL 709 (table 7).

TABLE 6

Fogging values determined (gravimetrically) according to DIN 75201

| Fatliquoring agent | Absolute fogging values in mg | Relative fogging values in % |
|---|---|---|
| A4 (conventional) | 2.80 | 100 |
| C4 (according to the invention) | 2.00 | 71.4 |
| B3 (conventional) | 3.35 | 100 |
| D3 (according to the invention) | 2.80 | 83.6 |

The leathers treated with the fatliquoring agents according to the invention (C4, D3) have lower fogging values than the leathers treated with conventional fatliquoring agents (A4, B3).

TABLE 7

VOC and fogging values determined according to PB VWL 709 (Daimler Chrysler)

| Fatliquoring agent | Absolute fogging values in ppm | Relative fogging values in % | Absolute VOC values in ppm | Relative VOC values in % |
|---|---|---|---|---|
| A4 | — | — | 228 | 100 |
| C4 | — | — | 185 | 81.1 |
| A4/B3 mixture (3/1, based on the weight) | 1389 | 100 | — | — |
| C4/D3 mixture (3/1, based on the weight) | 797 | 57.4 | — | — |

The results of the measurements show that the leathers treated with the fatliquoring agents according to the invention (C4, C4+D3) have lower fogging and also lower VOC values (VOC=volatile organic compounds) than the leathers treated with conventional fatliquoring agents (A4, A4+B3).

We claim:

1. A fatliquoring agent for the production and/or treatment of leather and hides comprising A) at least one modified natural oil and B) at least one stabilizer $L_nR$ in which

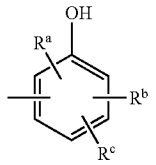

L— is $R^a$ is H or methyl;

$R^b$ is methyl, ethyl or tert-butyl, $R^c$ is methyl, tert-butyl, cyclohexyl or methylcyclohexyl, R is an n-valent, saturated or unsaturated, linear aliphatic $C_3$- to $C_{30}$- or branched aliphatic $C_4$- to $C_{30}$- or (hetero)cycloaliphatic $C_4$- to $C_{30}$- or (hetero) aromatic $C_4$- to $C_{30}$- hydrocarbon radical which is unsubstituted or substituted by carbonyl, alkylcarbonyloxy, alkylcarbamoyl and/or alkoxycarbonyl groups and/or contains O, N(H) and/or S units, and n is an integer from 1 to 10, the stabilizer $L_nR$ having altogether at least 20 carbon atoms and where n is 2, —R— also being —S—, —O—, —N(H)—, —$CH_2$—, —$(CH_2)_2$—, —$CH(CH_3)$—, —$(CH_2)_3$—, —$CH(C_2H_5)$— or —$C(CH_3)_2$—.

2. The fatliquoring agent of claim 1, wherein the modified natural oil is selected from the group consisting of modified fish oil, modified neatsfoot oil, modified lard oil, modified soybean oil, modified rapeseed oil, modified nut oil, modified olive oil and modified castor oil.

3. The fatliquoring agent of claim 1, wherein the modified natural oil is a modified phospholipid.

4. The fatliquoring agent of claim 1, which comprises at least 40% by weight of a component A or of a mixture of the components A, and not more than 1% by weight of a component B or of a mixture of the components B, based on the total weight of the fatliquoring agent.

5. The fatliquoring agent of claim 1, wherein the component B comprises at least one stabilizer LR (n=1) and R is selected from the group consisting of —$(CH_2)_9H$, —$CH(CH_3)$—$(CH_2)_{14}H$, —$(CH_2)_2$—C(O)$OCH_3$, —$(CH_2)_2$—C(O)O$iC_8H_{17}$, —$(CH_2)_2$—C(O)O$(CH_2)_{18}H$ and

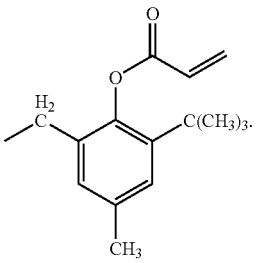

6. The fatliquoring agent of claim 1, wherein the component B comprises at least one stabilizer $L_2R$ (n=2) and R is selected from the group consisting of:

—S—, —O—, —N(H)—, —$CH_2$—, —$CH(CH(CH_3)_2)$, $CH(CH_2$—$CH_2$—$CH_3)$—,

—$(CH_2)_2$—C(O)—N(H)—N(H)—C(O)—$(CH_2)_2$—,

—$(CH_2)_2$—C(O)—$(CH_2)_6$—O—C(O)—$(CH_2)_2$—,

—$(CH_2)_2$—C(O)—N(H)—$(CH_2)_6$—N(H)—C(O)—$(CH_2)_2$—,

—$(CH_2)_2$—C(O)—(O—$CH_2$—$CH_2)_3$—O—C(O)—$(CH_2)_2$— and

—$(CH_2)_2$—C(O)—O—$CH_2$—$CH_2$—S—$CH_2$—$CH_2$—O—C(O)—$(CH_2)_2$—.

7. The fatliquoring agent of claim 1, wherein the component B comprises at least one stabilizer $L_4R$ (n=4) and R is $C(CH_2—O—C(O)—CH_2—CH_2—)_4$.

8. The fatliquoring agent of claim 1, wherein the component B comprises at least one stabilizer LR (n=1) and R is selected from the group consisting of:

—$(CH_2)_9H$, —$CH(CH_3)$—$(CH_2)_{14}H$, —$(CH_2)_2$—C(O)$OCH_3$, —$(CH_2)_2$—C(O)O$iC_8H_{17}$,

—$(CH_2)_2$—C(O)O$(CH_2)_{18}H$ and

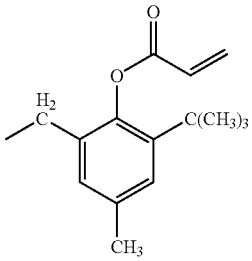

and at least one stabilizer $L_2R$ (n=2) and R is selected from the group consisting of:

—S—, —O—, —N(H)—, —$CH_2$—,

—$CH(CH(CH_3)_2)$—, —$CH(CH_2$—$CH_2$—$CH_3)$—,

—$(CH_2)_2$—C(O)—N(H)—N(H)—C(O)—$(CH_2)_2$—,

—$(CH_2)_2$—C(O)—O—$(CH_2)_6$—O—C(O)—$(CH_2)_2$—,

—$(CH_2)_2$—C(O)—N(H)—$(CH_2)_6$—N(H)—C(O)—$(CH_2)_2$—,

—$(CH_2)_2$—C(O)—(O—$CH_2$—$CH_2)_3$—O—C(O)—$(CH_2)_2$— and

—$(CH_2)_2$—C(O)—O—$CH_2$—$CH_2$—S—$CH_2$—$CH_2$—O—C(O)—$(CH_2)_2$—.

9. The fatliquoring agent of claim 1, wherein the component B comprises at least one stabilizer LR (n=1) and R is selected from the group consisting of:

—$(CH_2)_9H$, —$CH(CH_3)$—$(CH_2)_{14}H$, —$(CH_2)_2$—C(O)$OCH_3$, —$(CH_2)_2$—C(O)O$iC_8H_{17}$,

—$(CH_2)_2$—C(O)O$(CH_2)_{18}H$ and

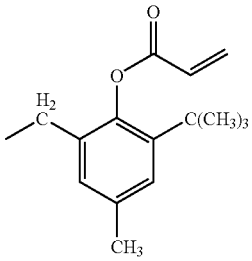

and at least one stabilizer $L_2R$ (n=2) and R is selected from the group consisting of:

—S—, —O—, —N(H)—, —$CH_2$—,

—$CH(CH(CH_3)_2)$—, —$CH(CH_2$—$CH_2$—$CH_3)$—,

—$(CH_2)_2$—C(O)—N(H)—N(H)—C(O)—$(CH_2)_2$—,

—$(CH_2)_2$—C(O)—O—$(CH_2)_6$—O—C(O)—$(CH_2)_2$—,

—$(CH_2)_2$—C(O)—N(H)—$(CH_2)_6$—N(H)—C(O)—$(CH_2)_2$—,

—$(CH_2)_2$—C(O)—(O—$CH_2$—$CH_2)_3$—O—C(O)—$(CH_2)_2$— and

—$(CH_2)_2$—C(O)—O—$CH_2$—$CH_2$—S—$CH_2$—$CH_2$—O—C(O)—$(CH_2)_2$— and at least one stabilizer $L_4R$ (n=4) and R is $C(CH_2—O—C(O)—CH_2—CH_2—)_4$.

10. The fatliquoring agent of claim 1, wherein the component B comprises at least one stabilizer $L_2R$ (n=2) and R is selected from the group consisting of:

—S—, —O—, —N(H)—, —$CH_2$—, —$CH(CH(CH_3)_2)$—, —$CH_2(CH_2CH_2$—$CH_3)$—,

—$(CH_2)_2$—C(O)—N(H)—N(H)—C(O)—$(CH_2)_2$—,

—$(CH_2)_2$—C(O)—$(CH_2)_6$—O—C(O)—$(CH_2)_2$—,

—$(CH_2)_2$—C(O)—N(H)—$(CH_2)_6$—N(H)—C(O)—$(CH_2)_2$—,

—$(CH_2)_2$—C(O)—(O—$CH_2$—$CH_2)_3$—O—C(O)—$(CH_2)_2$— and

—$(CH_2)_2$—C(O)—O—$CH_2$—$CH_2$—S—$CH_2$—$CH_2$—O—C(O)—$(CH_2)_2$— and at least one stabilizer $L_4R$ (n=4) and R is $C(CH_2—O—C(O)—CH_2—CH_2—)_4$.

11. The fatliquoring agent of claim 1, wherein the component B comprises at least one stabilizer $L_3R$ (n=3) and R is selected from the group consisting of:

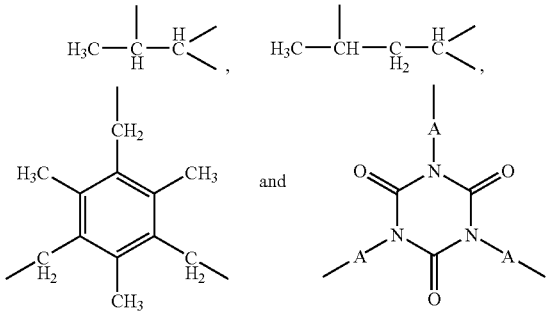

where A is $CH_2$ or $(CH_2)_2$—C(O)—$(CH_2)_2$.

12. The fatliquoring agent of claim 1, wherein the modified natural oil is an oxidized natural oil having a specific gravity which differs from the specific gravity of a corresponding unoxidized natural oil by a Δd of from 0.01 to 0.1 g/ml.

13. The fatliquoring agent of claim 1, wherein the modified natural oil is oxidized natural oil having a specific gravity which differs from the specific gravity of a corresponding unoxidized natural oil by a Δd of from 0.03 to 0.05 g/ml.

14. The fatliquoring agent of claim 1, wherein the modified natural oil is a sulfitated natural oil which is obtained by reacting the natural oil with from 2 to 8% by weight, based on its weight of a sulfite, calculated as sodium bisulfite ($Na_2S_2O_5$).

15. The fatliquoring agent of claim 3, wherein the modified natural oil is an acetylated phospholipid.

16. The fatliquoring agent of claim 4, which comprises at least 50% by weight of a component A or of a mixture of the components A, based on the total weight of the fatliquoring agent.

17. A method for the treatment of leather and hides, wherein the leather and hides is/are contacted with the fatliquoring agent of claim 1.

18. The method of claim 17, wherein the leather and hides have been tanned in the absence of chromium.

19. A process for fatliquoring in the production of leather and hides with an aqueous dispersion, wherein the aqueous dispersion contains from 40 to 80% by weight of a fatliquoring agent of claim 1.

20. A process for fatliquoring in the treatment of leather and hides with an aqueous dispersion, wherein the aqueous dispersion contains from 40 to 80% by weight of a fatliquoring agent of claim 1.

* * * * *

UNITED STATES PATENT AND TRADEMARK OFFICE

CERTIFICATE OF CORRECTION

PATENT NO. : 7,192,534 B2
APPLICATION NO. : 10/503306
DATED : March 20, 2007
INVENTOR(S) : Lunkwitz et al.

It is certified that error appears in the above-identified patent and that said Letters Patent is hereby corrected as shown below:

On the title page item (75),
In the Abstract, line 14:
"$–CH_2)_3–$" should read -- $–(CH_2)_3–$ --

Signed and Sealed this

Tenth Day of July, 2007

JON W. DUDAS
*Director of the United States Patent and Trademark Office*